US006795104B2

(12) United States Patent
Shiraiwa

(10) Patent No.: US 6,795,104 B2
(45) Date of Patent: Sep. 21, 2004

(54) THERMAL TRANSFER RECORDING APPARATUS, THERMAL TRANSFER RECORDING PROCESS AND INK SHEET

(75) Inventor: Yoshinobu Shiraiwa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/316,879

(22) Filed: Dec. 12, 2002

(65) Prior Publication Data

US 2003/0117480 A1 Jun. 26, 2003

(30) Foreign Application Priority Data

Dec. 26, 2001 (JP) ..... 2001-394030

(51) Int. Cl.[7] ..... B41J 2/315
(52) U.S. Cl. ..... 347/212
(58) Field of Search ..... 347/212–214, 347/171–172, 174, 176, 217–218, 100–101; 400/120.02, 120.04, 120.18

(56) References Cited

U.S. PATENT DOCUMENTS 6,270,930 B1 * 8/2001 Okabe ..... 430/7
6,480,217 B1 * 11/2002 Inoue et al. ..... 347/212

FOREIGN PATENT DOCUMENTS

JP 10-175375 A 6/1998

* cited by examiner

*Primary Examiner*—K. Feggins
(74) *Attorney, Agent, or Firm*—Fitzpatrick, Cella, Harper & Scinto

(57) ABSTRACT

Disclosed herein are an ink sheet for thermal transfer recording, wherein a surface for thermal transfer treatment arranged in opposed relation to an image-receiving paper sheet has at least one of the portions divided into first and second ink layer regions each provided with a thermal transfer type ink layer and a light-shielding-layer-forming region provided with a thermal transfer type light-shielding-layer-forming layer, the first ink layer region is used for thermal transfer to the image-receiving paper sheet before the formation of a light-shielding layer, and the second ink layer region is used for thermal transfer to the image-receiving paper sheet after the formation of the light-shielding layer, and a thermal transfer recording process and a thermal transfer recording apparatus which provide a double-side recorded article using the ink sheet.

9 Claims, 2 Drawing Sheets

THERMAL TRANSFER RECORDING APPARATUS, THERMAL TRANSFER RECORDING PROCESS AND INK SHEET

BACKGROUND OF THE INVENTION

1. Field of the Invention

The present invention relates to a recording apparatus by which an image-receiving paper sheet and an ink sheet are relatively and reciprocatively to conduct image recording with a single color or a plurality of colors, and a set of an image-receiving paper sheet containing a transparent portion in a recording region thereof, which permits viewing an image formed from a backside thereof, and an ink sheet, said set being used in the recording apparatus, and more particularly to a recording apparatus which provides small-sized and cheap recording means capable of recording desired images on both sides of a sheet by one printing operation without need of manual labor or complicated arrangement construction, and a set of an image-receiving paper sheet containing a transparent portion in a recording region thereof, which permits viewing an image formed from a backside thereof, and an ink sheet, said set being used in the recording apparatus.

2. Related Background Art

With the spread of digital video cameras and digital cameras in present, there is a great demand for color printers which record color images obtained thereby. One of the recording systems employed in such color printers is such a method that prescribed portions of an ink sheet coated with a thermally sublimating or melting ink are selectively heated in response to recording information by a thermal head to transfer an ink image to recording paper (image-receiving paper sheet). In particular, a sublimation type thermal transfer-recording apparatus provides a high-quality full-color image and is expected to be a color printer for digital cameras. A melting type thermal transfer-recording apparatus is spread as an apparatus capable of cheaply recording characters or the like.

In a thermal transfer-recording apparatus, a platen roller and a thermal head, in which heating elements to be selectively heated in response to recording information are arranged, are generally provided in opposed relation to each other, an image-receiving paper sheet is relatively and reciprocatively moved with respect to the thermal head on a conveying path of the image-receiving paper sheet and an ink sheet provided between the thermal head and the platen roller in such positional relation that the image-receiving paper sheet and the ink sheet are held between the thermal head and the platen roller, and a prescribed surface of the ink sheet is conveyed to a recording region of the image-receiving paper sheet arranged oppositely to the thermal head, thereby conducting recording of an image. The thermal transfer recording is conducted for every color in the same recording region of the image-receiving paper sheet with an ink layer of plural colors, whereby recording of the plural colors can be conducted. At this time, the positional relation among the platen roller, image-receiving paper sheet, ink sheet and thermal head is such that the image-receiving paper sheet is located on the platen roller, the ink sheet is located on the image-receiving paper sheet, and the thermal head is located on the ink sheet. In this state, the heating elements of the thermal head are selectively heated to sublimate and transfer or melt and transfer inks of corresponding ink sheet portions to a surface portion of the image-receiving paper sheet in contact with the ink sheet, thereby conducting recording of an image on the image-receiving paper sheet. Accordingly, a surface of the image-receiving paper sheet, on which an image can be recorded, is limited to a surface in contact with the ink sheet. Therefore, the surface in contact with the ink sheet had to be changed by some method, for example, by turning the image-receiving paper sheet upside down in order to conduct recording of images on both sides of the image-receiving paper sheet. However, a mechanism of turning the image-receiving paper sheet is required for turning it upside down, and so such problems that the recording apparatus becomes large, and it takes a time to turn the paper upside down have arisen.

In order to solve these problems, Japanese Patent Application Laid-Open No. 10-175375 teaches that a first image is thermally transferred to a transparent film with a single or plural color thermal transfer-recording media, a covering transfer-recording medium is thermally transferred to the support (film) so as to overlap the first image, and a second image is then thermally transferred to the covered portion with a single or plural color thermal transfer-recording media each having a color thermal transfer ink layer.

According to the above-described method, however, it has been necessary to separately align the covering transfer-recording medium with the first image after the formation of the first image though there is no need to turn the image-receiving paper sheet upside down.

SUMMARY OF THE INVENTION

The present invention has been made with the foregoing circumstances in view and has as its object the provision of a small-sized and cheap recording apparatus capable of providing desired printed images on both sides of an image-receiving paper sheet to be subjected to double-side printing, and an ink sheet and a recording process used therein.

The above object can be achieved by the following respective aspects of the present invention.

In an aspect of the present invention, there is provided an ink sheet for use in thermal transfer recording comprising a surface for thermal transfer treatment arranged in opposed relation to an image-receiving paper sheet, the surface having a first and second ink layer regions each provided with a thermal transfer type ink layer and a light-shielding-layer-forming region provided with a thermal transfer type light-shielding-layer-forming layer, wherein the first ink layer region is used for thermal transfer to the image-receiving paper sheet before the formation of a light-shielding layer, and the second ink layer region is used for thermal transfer to the image-receiving paper sheet after the formation of the light-shielding layer.

In another aspect of the present invention, there is provided a thermal transfer recording apparatus, comprising arranging means for arranging a surface for thermal transfer treatment of an ink sheet in opposed relation to a recording region of an image-receiving paper sheet, which has a transparent portion that allows viewing an image formed from a backside thereof, and a recording section having heating means, wherein the surface for thermal transfer treatment of the ink sheet arranged in opposed relation to the image-receiving paper sheet has a first and second ink layer regions each provided with a thermal transfer type ink layer and a light-shielding-layer-forming region provided with a thermal transfer type light-shielding-layer-forming layer, and the recording apparatus has control means for conducting thermal transfer recording with the first ink layer region, thermally transferring the light-shielding-layer-forming layer from the light-shielding-layer-forming region and then conducting thermal transfer recording with the second ink layer region to the same recording region of the image-receiving paper sheet.

In a further aspect of the present invention, there is provided a thermal transfer recording process for recording an image in a recording region of an image-recording paper sheet by heating a surface for thermal transfer treatment of an ink sheet on the basis of recording information by means of heating means provided in a recording section of a recording apparatus under such a condition that the surface is arranged opposite to the recording region of the image-receiving paper sheet, which has a transparent portion that allows viewing an image formed from a backside thereof, wherein the surface for thermal transfer treatment of the ink sheet arranged opposite to the image-receiving paper sheet has a first and second ink layer regions each provided with a thermal transfer type ink layer and a light-shielding-layer-forming region provided with a thermal transfer type light-shielding-layer-forming layer, the process comprising the steps of conducting thermal transfer recording with the first ink layer region, forming a light-shielding layer by thermal transfer of the light-shielding-layer-forming layer and then conducting thermal transfer recording on the light-shielding layer with the second ink layer region to the same recording region of the image-receiving paper sheet.

DETAILED DESCRIPTION OF THE PREFERRED EMBODIMENTS

Recording portions of the ink sheet according to the present invention are first and second ink layer regions each provided with a thermal transfer type ink layer and a thermal transfer type light-shielding-layer-forming region. With respect to the arrangement position of the ink layer in the ink layer region, the ink layer may be either provided on the whole surface of the ink layer region (see, for example, FIG. 2) or partially provided on a prescribed portion of the ink layer region. With respect to the light-shielding-layer, the light-shielding-layer may be either provided on the whole surface of the light-shielding-layer-forming region (see, for example, FIG. 2) or partially provided.

Adjacent regions among the ink layer regions and the light-shielding-layer-forming region may be arranged either in direct contact with each other or with a prescribed spacing.

On the other hand, at least one of the first and second ink layer regions may have a plurality of ink layers. For example, at least two ink layers different in color from each other may be arranged in at least one of these regions as illustrated in, for example, FIG. 2, thereby conducting thermal transfer recording on at least one surface of an image-receiving paper sheet with plural colors.

Figure 2:
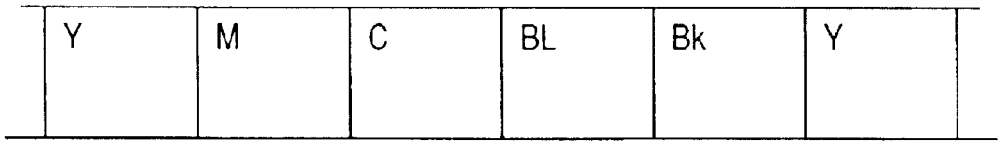
FIG. 2 illustrates the structure of an ink sheet used in the present invention.

The arrangement of the first and second ink layer regions and the light-shielding-layer-forming region is preferably such that the first ink layer region, the light-shielding-layer-forming region and the second ink layer region are arranged in that order from in a moving direction at the time the surface for thermal transfer treatment of the ink sheet is moved relatively to heating means when conducting thermal transfer recording. Incidentally, when at least two unit portions each composed of the first and second ink layer regions and the light-shielding-layer-forming region may be used, and a plurality of ink layers are arranged in parallel in the ink layer region, the arrangement order of the plural ink layers in the respective unit portions may be the same or different. However, the arrangement order may preferably be the same as illustrated in FIG. 2, which will be described subsequently, taking efficient control of recording, simplification of arrangement construction, etc. into consideration.

The form of the ink sheet is preferably such that the above-described respective regions are successively arranged in series in a band-shaped surface or region. The form is more preferable such that the respective regions are arranged on a band-shaped base.

In addition, the light-shielding-layer-forming region for light-shielding layers may be formed in a pattern in advance, thereby imparting a prescribed light-shielding pattern to the resulting printed article. Further, print patterns such as characters, designs and/or various images may be applied in advance on any one of the upper surface and lower surface of the light-shielding-layer-forming layer, whereby these print patterns may be transferred together with the light-shielding layer to the image-receiving paper sheet.

As the first and second ink layers according to the present invention, are used ink layers used in thermal transfer sheets. The light-shielding-layer-forming layer is formed by forming a thermally melting resin layer on both sides of a thin metal film layer. As for a process for forming the light-shielding-layer-forming layer, there is a process in which a thermally melting resin layer is formed on both sides of an aluminum foil, or a process in which a thin film of a metal such as aluminum is vapor-deposited on a thermally melting resin layer. When the thermally melting resin layer is formed on both sides of the aluminum foil, the light-shielding-layer-forming layer can be formed in accordance with, for example, a method in which a thermally melting resin layer is formed on a support, and an aluminum foil cut in a certain pattern is laminated on the thermally melting resin layer.

In order to enhance color reproducibility of both images on front and back surfaces, each thermally melting resin layer is preferably light diffusible. The thermally melting resin layer can be made light diffusible by making the thermally melting resin layer have voids or by mixing a white pigment such as titanium oxide into the thermally melting resin layer. The thermally melting resin layer is made light transmissible, whereby the background of the resulting printed article can be made to have a metallic color. One of the thermally melting resin layers, between which the thin metal film layer is held, may also be made light diffusible, and the other may be made light transmissible.

In the image-receiving paper sheet used in the present invention, a transparent portion capable of viewing an image formed by an ink thermally transferred prior to the light-shielding layer from a backside thereof is formed in the whole recording region or a portion required for the viewing in such a manner that at least a part (portion to be viewed) of the image can be viewed from the backside opposite to the light-shielding layer.

The thermal transfer recording apparatus according to an embodiment of the present invention will hereinafter be described with reference to the accompanying drawing.

Figure 1:
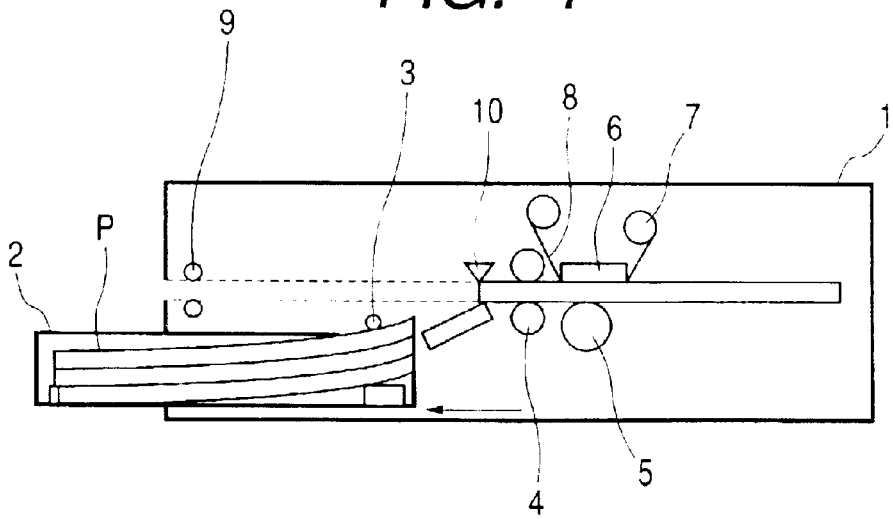
FIG. 1 is a side elevation schematically illustrating a thermal transfer recording apparatus according to an embodiment of the present invention.

FIG. 1 is a side elevation schematically illustrating the recording apparatus according to the embodiment of the present invention. The whole construction of the recording apparatus will be described. This apparatus has an apparatus body 1 and a paper cassette 2. Sheets of image-receiving paper sheet P are separately fed one by one by a paper feed roller 3 to the apparatus body 2 from the paper cassette 2 into which the sheets of paper are loaded. The image-receiving paper sheet fed is held and conveyed by a pair of conveying rollers 4 forming arranging means in such a manner that reciprocating movement to a recording section becomes feasible.

In this embodiment, a case where a color image is formed with the first ink layer, and a black image is formed with the second ink layer will be described as an example.

In the recording section, a platen roller 5 and a thermal head 6, which is a heating means for heating in response to recording information, are arranged in opposed relation to each other through a conveying path for image-receiving paper sheet. A tape (strip)-like ink sheet 8 contained in an ink cassette 7 and having the first ink layer containing a thermally sublimating ink, the second ink layer which is a layer of a thermally melting ink, and the light-shielding-layer-forming layer is pressed by the thermal head 6 against the image-receiving paper sheet P and at the same time selectively heated, whereby the thermally sublimating ink in the first ink sheet is first sublimated and transferred to the image-receiving paper sheet P to transfer and record a prescribed image. Since the image is formed with the thermally sublimating ink, a high-fineness color image is provided.

The light-shielding-layer-forming layer is then transferred to form a light-shielding layer.

Further, the thermally melting ink in the second ink layer is melted and transferred to the image-receiving paper sheet P, on which the light-shielding layer has been formed to record a desired printed image. Since the thermally melting ink is used as the second ink, a high-quality black image is provided. In particular, when characters are printed, clear characters are provided. The ink sheet 8 is moved in a direction of a going path to the recording section to successively feed the ink layer and light-shielding-layer-forming layer forward to the thermal head. On the ink sheet, units, in which yellow (Y), magenta (M), cyan (C), BL (light-shielding-layer-forming layer) and black (Bk) have been arrayed in that order, are arranged in series in plenty, and these arrays are formed repeatedly. The step of using these respective ink layers and light-shielding-layer-forming layers in a prescribed order to successively conduct thermal transfer can be performed by controlling the operation of mechanisms such as the pair of conveying rollers by indication from controlling means provided in the apparatus body 1.

In this embodiment, the thermal transfer feasible temperature and melting point of the second ink layer are preferably higher than those of the light-shielding-layer-forming layer. Upon the transfer of the second ink layer, a clearer black image is provided without melting the thermally melting resin of the light-shielding-layer-forming layer again.

The ink sheet is such that the respective thermally sublimating ink layers of yellow (Y), magenta (M) and cyan (C), the light-shielding-layer-forming layer and the thermally melting ink layer of black (Bk) are arranged in substantially the same size as that of a printing (recording) region of the image-receiving paper sheet (P) so as to overlap the recording region. An operation in which the thermal transfer of each layer is conducted, and the image-receiving paper sheet P is then returned to a recording-starting position is repeated to perform a thermal transfer treatment, so that these layers are successively overlapped each other on the image-receiving paper sheet P. In other words, an ink layer or light-shielding-layer-forming layer of the ink sheet is arranged in opposed relation to the image-receiving paper sheet P during movement of the image-receiving paper sheet P along the going path and heated by the heating means with the surface of such layers brought into contact with the paper.

As for the heating means making up the recording section, may be used those of various types such a type that the heating means are brought into contact with the whole surface of the recording region to conduct recording, such a type that heating elements are scanned to conduct recording at every line or row and such a type that heating elements are arranged in a row or plural rows and moved relatively to the image-receiving paper sheet to conduct recording at every line. However, a type that heating elements are arranged in the full width of the band-shaped ink sheet in this embodiment is preferred from the viewpoint of efficiency of recording operation. In this case, one of such a type that the heating means are brought into contact with the whole surface of the recording region to conduct recording, or such a type that heating elements are arranged in a row or plural rows and moved relatively to the image-receiving paper sheet to conduct recording at every line may be preferably used. In the present invention, the ink sheet is not limited to the form of the band (tape), and that in the form of a sheet may also be used.

FIG. 2 illustrates the structure of an ink sheet used in the present invention.

In the drawing, portions indicated by Y, M and C are portions that the respective thermally sublimating ink layers of yellow (Y), magenta (M) and cyan (C) have been applied to a base material of the ink sheet, a portion indicated by BL is a portion that the light-shielding-layer-forming layer has been formed on the base material of the ink sheet, and a portion indicated by Bk is a portion that the thermally melting ink layer of black has been applied to the base material of the ink sheet. As the base material and ink layers making up the ink sheet, may be used publicly known ones.

Figure 3:
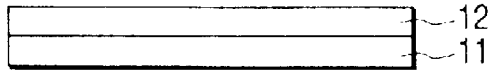
FIG. 3 is a cross-sectional view of a portion of the ink sheet, to which a layer of thermally sublimating ink has been applied.

FIG. 3 is a cross-sectional view illustrating a portion of the ink sheet, to which a thermally sublimating ink layer 12 has been applied on to a base material 11.

Figure 4:
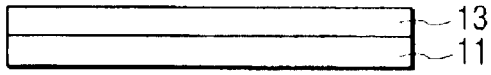
FIG. 4 is a cross-sectional view of a portion of the ink sheet, to which a light-shielding-layer-forming layer has been formed.
Figure 5:
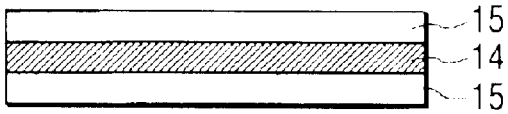
FIG. 5 is a cross-sectional view of the light-shielding-layer-forming layer.

FIG. 4 is a cross-sectional view illustrating a portion of the ink sheet, to which a light-shielding-layer-forming layer 13 has been formed on to the base material 11. In this embodiment, a layer that a light-diffusible resin layer 15 had been formed on both sides of an aluminum foil 14 thinly formed as illustrated in FIG. 5 was used as the light-shielding-layer-forming layer 13. Incidentally, the resin layer located on the side of the base material and the resin layer to be melted and bonded to the image-receiving paper sheet P located on the opposite side through the aluminum foil may be formed by either the same resin materials or different resin materials from each other.

The aluminum foil has been formed in advance in a desired pattern, whereby a desired light-shielding pattern can be imparted to the resulting recorded article.

As for the structure of the light-shielding-layer-forming layer, is preferred the structure composed of the aluminum foil 14 and the resin layers 15 as described above in that it can be formed by a simple method, and the desired light-shielding property can be easily imparted. However, the present invention is not limited to this structure, and various structures such as a structure that fine particles of an inorganic pigment or the like are dispersed in a resin layer to impart the light-shielding property may also be used.

Figure 6:
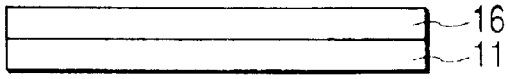
FIG. 6 is a cross-sectional view of a portion of the ink sheet, to which a layer of thermally melting ink has been applied.

FIG. 6 is a cross-sectional view illustrating a portion of the ink sheet, to which a thermally melting ink layer 16 has been applied on to the base material 11.

Figure 7:
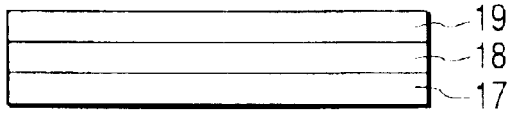
FIG. 7 is a cross-sectional view of an image-receiving paper sheet.

FIG. 7 is a cross-sectional view illustrating an image-receiving paper sheet.

The image-receiving paper sheet in this embodiment has a structure that a receiving layer 18 has been formed on a transparent base material 17, and a parting layer 19 has been formed thereon. The parting layer 19 serves to prevent abnormal transfer of the thermally sublimating ink layer to the image-receiving paper sheet upon contact of the thermally sublimating ink layer with the image-receiving paper sheet to transfer the ink to the receiving layer of the image-receiving paper sheet. The resin layer of the light-shielding-layer-forming layer formed on the ink sheet is then bonded by applying heat to form a light-shielding layer on the image-receiving paper sheet. Incidentally, it is only necessary that the receiving layer 18 be formed by such a material and in such a layer thickness that an image formed thereon can be viewed on the side of the transparent base material 17. The receiving layer itself may also be transparent. In this embodiment, a transparent material is used as the base material 17 of the image-receiving paper sheet. However, a transparent portion and an opaque portion may also be provided in terms of a thickness-wise direction of the base material so as to view the image from the transparent portion.

Figure 8:
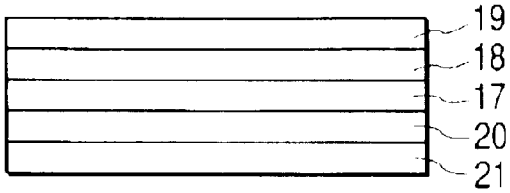
FIG. 8 is a cross-sectional view of an image-receiving paper sheet provided with a protecting layer on a lower surface of a base material through a release layer.

In this embodiment, the image-receiving paper sheet of the above-described structure was used. However, it is effective to provide a protecting layer 21 on a lower surface of the base material 17 through a release layer 20 as illustrated in FIG. 8 for the purpose of preventing the base material from being damaged during conveyance of the image-receiving paper sheet, or so. The base material may also be processed for imparting the writing properties or the like to the base material.

Figure 9:
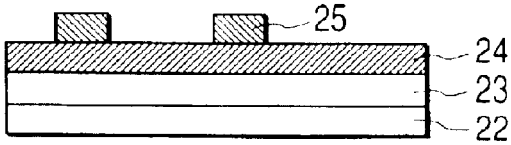
FIG. 9 is a cross-sectional view of a printed article formed in the present invention.

FIG. 9 is a cross-sectional view illustrating an exemplary printed article finally formed by practicing this embodiment.

The lowest layer 22 is the base material layer of the image-receiving paper sheet and serves as a protecting layer for an image printed by the thermally sublimating ink transferred to the receiving layer in a final printed article. A layer 23 second from the bottom is an image-recorded layer in which an image has been formed by the thermally sublimating ink. The next layer 24 becomes a light-shielding layer. This light-shielding layer does not transmit the image printed on the image-recorded layer above this layer. Accordingly, the image transferred and recorded on the image-receiving paper sheet can be viewed only from the side of the base material in FIG. 9. The uppermost layer 25 is a print-recorded layer formed and recorded by, transferring the ink in the thermally melting ink layer to the light-shielding layer formed on the image-receiving paper sheet by heating. The light-shielding layer screens the printed image formed on this print-recorded layer and does not transmit it below this in FIG. 9. This image can be viewed only from the side of the print-recorded layer.

As described above, a printed article in which respective desired images have been formed on both sides thereof can be provided without changing a contact surface between the ink sheet and the image-receiving paper sheet, which is an object of the present invention.

The image printed on the image-recorded layer shows an enantiomorphic relation between an image formed upon printing and an image viewed through the base material from the backside of the image-receiving paper sheet at the time finally provided as a double-side printed article by the formation of the light-shielding layer. When this image is formed by an ordinary printing method, it becomes an enantiomorphic image. Therefore, an image is printed by reversing in an enantiomorphic relation, whereby a desired image can be formed even by the ordinary printing method.

An article desired to be subjected to double-side printing is generally a postal card or the like. In this case, an address or the like is often printed on the print-recorded layer recorded by transferring the thermally melting ink. Accordingly, it is convenient from the viewpoint of practical use that particular print patterns such as a frame of a postage stamp and a frame of a zip code be printed in advance on a side of the light-shielding-layer-forming layer, on which the thermally melting ink layer is transferred and recorded.

As described above, the image-receiving paper sheet P is reciprocatively moved by the times corresponding to the number of the thermally sublimating ink layers of the respective colors, the light-shielding-layer-forming layer and the thermally melting ink layer by the pair of conveying rollers 4 without turning the image-receiving paper sheet upside down and finally guided to a pair of discharge rollers 9, thereby discharging it to complete the recording operation.

In an ordinary thermal transfer recording apparatus capable of conducting full-color printing, recording is successively performed three times with three colors of Y, M and C. Therefore, it is necessary to precisely align and control front edges when conducting recording with the respective colors. It is thus necessary to firmly hold the image-receiving paper sheet P by the pair of conveying rollers 4 as illustrated in FIG. 1 for conveying the paper sheet without releasing it. Accordingly, a blank portion incapable of recording is thus required at an end of the image-receiving paper sheet P. In view of this fact, perforations may also be provided in the image-receiving paper sheet P in such a manner that the blank portion incapable of recording firmly held by the pair of conveying rollers 4 upon the beginning of the recording can be easily cut off by hand to provide a printed article free of any edge.

According to the present invention, as described above, a recorded article in which respective desired images have been printed on both sides of an image-receiving paper sheet can be provided without changing a contact surface between an ink sheet and the image-receiving paper sheet, and so a small-sized and cheap recording apparatus capable of printing images on both sides of the image-receiving paper sheet, and a simple double-side image-forming process can be provided.

What is claimed is:

1. An ink sheet for use in thermal transfer recording comprising a surface for thermal transfer treatment arranged in opposed relation to an image-receiving paper sheet, the surface having a first and second ink layer regions each provided with a thermal transfer type ink layer and a light-shielding-layer-forming region provided with a thermal transfer type light-shielding-layer-forming layer, wherein the first ink layer region is used for thermal transfer to the image-receiving paper sheet before the formation of a light-shielding layer, and the second ink layer region is used for thermal transfer to the image-receiving paper sheet after the formation of the light-shielding layer.

2. The ink sheet according to claim 1, wherein the first ink layer region, the light-shielding-layer-forming region and the second ink layer region are arranged in that order in a feeding direction to a recording section of a recording apparatus having heating means.

3. The ink sheet according to claim 2, wherein the first ink layer region, the light-shielding-layer-forming region and the second ink layer region are arranged on one surface of a band-shaped base material in series in that order in the feeding direction.

4. A thermal transfer recording apparatus, comprising arranging means for arranging a surface for thermal transfer treatment of an ink sheet in opposed relation to a recording region of an image-receiving paper sheet, which has a transparent portion that allows viewing an image formed from a backside thereof, and a recording section having heating means, wherein the surface for thermal transfer treatment of the ink sheet arranged in opposed relation to the image-receiving paper sheet has a first and second ink layer regions each provided with a thermal transfer type ink layer and a light-shielding-layer-forming region provided with a thermal transfer type light-shielding-layer-forming layer, and the recording apparatus has control means for conducting thermal transfer recording with the first ink layer region, thermally transferring the light-shielding-layer-forming layer from the light-shielding-layer-forming region and then conducting thermal transfer recording with the second ink layer region to the same recording region of the image-receiving paper sheet.

5. The thermal transfer recording apparatus according to claim 4, wherein the first ink layer region, the light-shielding-layer-forming region and the second ink layer region are arranged in that order in a feeding direction of the ink sheet to the recording section.

6. The thermal transfer recording apparatus according to claim 4, wherein the ink sheet has a strip-like surface for thermal transfer treatment, in which the first ink layer region, the light-shielding-layer-forming region and the second ink layer region are arranged in series in that order in the feeding direction to the recording section, the heating means has a structure that heating elements are arranged over the full width of the band-shaped surface, the control means causes the image-receiving paper sheet to reciprocatively move relative to the heating means, and the image-receiving paper sheet and the band-shaped surface are arranged opposite to each other in the reciprocative movement of the image-receiving paper sheet to conduct the thermal transfer treatment.

7. A thermal transfer recording process for recording an image in a recording region of an image-recording paper sheet by heating a surface for thermal transfer treatment of an ink sheet on the basis of recording information by means of heating means provided in a recording section of a recording apparatus under such a condition that the surface is arranged opposite to the recording region of the image-receiving paper sheet, which has a transparent portion that allows viewing an image formed from a backside thereof, wherein the surface for thermal transfer treatment of the ink sheet arranged opposite to the image-receiving paper sheet has a first and second ink layer regions each provided with a thermal transfer type ink layer and a light-shielding-layer-forming region provided with a thermal transfer type light-shielding-layer-forming layer, the process comprising the steps of conducting thermal transfer recording with the first ink layer region, forming a light-shielding layer by thermal transfer of the light-shielding-layer-forming layer and then conducting thermal transfer recording on the light-shielding layer with the second ink layer region to the same recording region of the image-receiving paper sheet.

8. The thermal transfer recording process according to claim 7, wherein the first ink layer region, the light-shielding-layer-forming region and the second ink layer region are arranged in that order in a feeding direction of the ink sheet to the recording section.

9. The thermal transfer recording process according to claim 8, wherein the ink sheet has a band-shaped surface for thermal transfer treatment, in which the first ink layer region, the light-shielding-layer-forming region and the second ink layer region are arranged in series in that order in the feeding direction to the recording section, the heating means has a structure that heating elements are arranged over the full width of the band-shaped surface, the image-receiving paper sheet is reciprocatively moved relative to the heating means, and the image-receiving paper sheet and the band-shaped surface are arranged relatively to each other in the reciprocative movement of the image-receiving paper sheet to conduct thermal transfer treatment.

* * * * *

UNITED STATES PATENT AND TRADEMARK OFFICE

CERTIFICATE OF CORRECTION

PATENT NO. : 6,795,104 B2
DATED : September 21, 2004
INVENTOR(S) : Shiraiwa

It is certified that error appears in the above-identified patent and that said Letters Patent is hereby corrected as shown below:

Column 1,
Line 28, “in” should read -- at --.

Column 4,
Line 21, “in a” should read -- the --.

Column 6,
Line 23, “are successively overlapped” should read -- successively overlap --.
Line 31, “such” should read -- such as --.

Signed and Sealed this

Eighth Day of February, 2005

JON W. DUDAS
*Director of the United States Patent and Trademark Office*